US008378773B2

(12) United States Patent
Nishino et al.

(10) Patent No.: US 8,378,773 B2
(45) Date of Patent: Feb. 19, 2013

(54) MAGNETIC ELEMENT

(75) Inventors: Tatsumi Nishino, Tokyo (JP); Yoshito Watanabe, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 13/247,189

(22) Filed: Sep. 28, 2011

(65) Prior Publication Data

US 2012/0081205 A1 Apr. 5, 2012

(30) Foreign Application Priority Data

Oct. 4, 2010 (JP) ..... 2010-225214

(51) Int. Cl.

| | |
|---|---|
| ***H01F 27/30*** | (2006.01) |
| ***H01F 27/02*** | (2006.01) |
| ***H01F 27/36*** | (2006.01) |
| ***H01F 38/30*** | (2006.01) |
| ***H01F 27/29*** | (2006.01) |
| ***H01F 27/24*** | (2006.01) |

(52) U.S. Cl. ..... 336/198; 336/83; 336/84 R; 336/84 C; 336/84 M; 336/192; 336/212

(58) Field of Classification Search ..... 336/83, 336/84 R, 84 C, 84 M, 192, 198, 200, 212
See application file for complete search history.

(56) References Cited

U.S. PATENT DOCUMENTS

| | | | | |
|---|---|---|---|---|
| 7,057,486 | B2 * | 6/2006 | Kiko | 336/178 |
| 2006/0267716 | A1 | 11/2006 | Peng et al. | |

FOREIGN PATENT DOCUMENTS

| | | | |
|---|---|---|---|
| JP | 10-12457 | A | 1/1998 |
| JP | 2001-313214 | A | 11/2001 |
| JP | 2007-96181 | A | 4/2007 |
| WO | 2008/009350 | A1 | 1/2008 |

OTHER PUBLICATIONS

Extended European Search Report for Application No./Patent No. 11007969-2208/2437273, dated Mar. 7, 2012.

* cited by examiner

*Primary Examiner* — Mohamad Musleh
*Assistant Examiner* — Tsz Chan
(74) *Attorney, Agent, or Firm* — Cantor Colburn LLP

(57) ABSTRACT

A problem to be solved is to prevent leakage of magnetic flux in a magnetic element. A magnetic element has a winding having conductivity, and a core member disposed in a state that the winding is wound, in which the core member includes a first core member having a bottom wall and a plurality of peripheral walls provided to stand on peripheral side portions of the bottom wall, and a second core member having a plate shape which is cross-shaped or substantially cross-shaped, in which cutout portions for allowing fitting of end portions of the cross shape of the second core member are formed in the peripheral walls of the first core member.

11 Claims, 17 Drawing Sheets

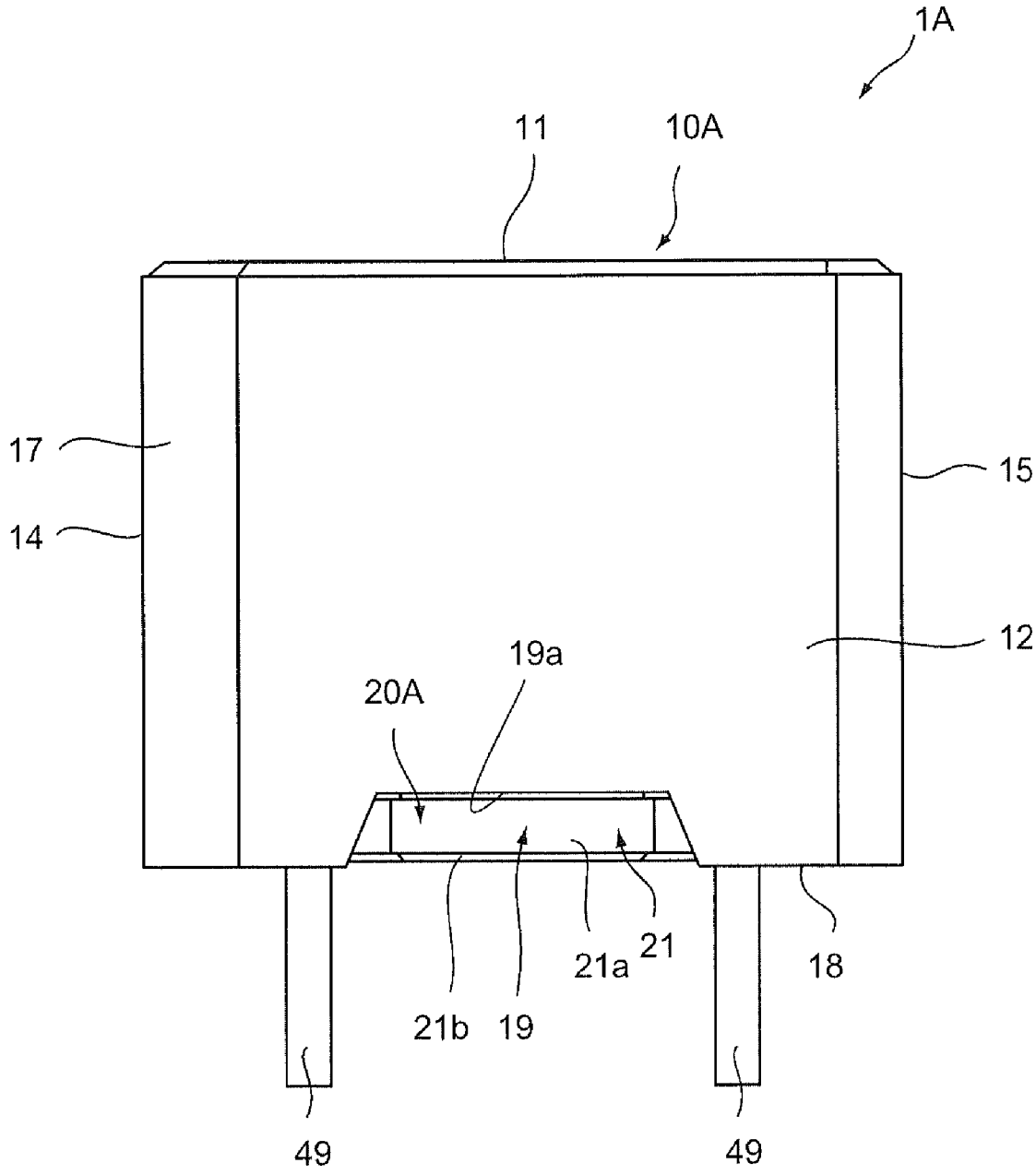
Fig.4
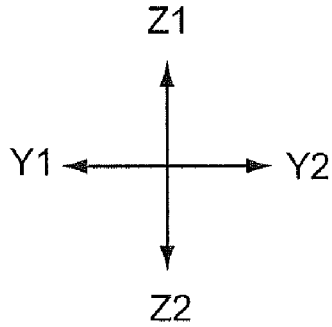

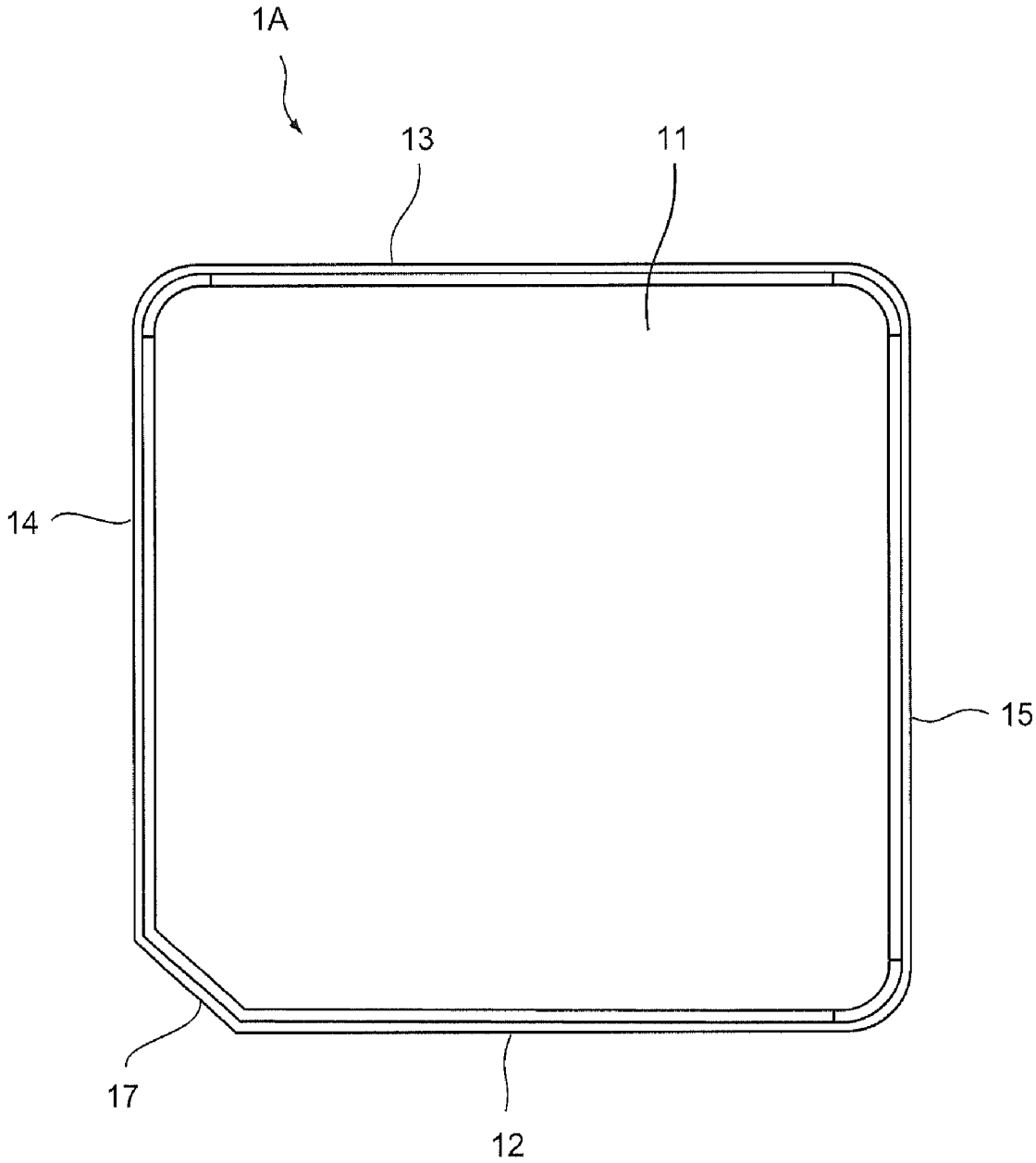
Fig.8
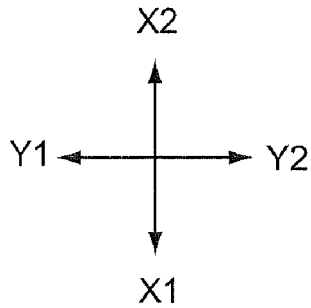

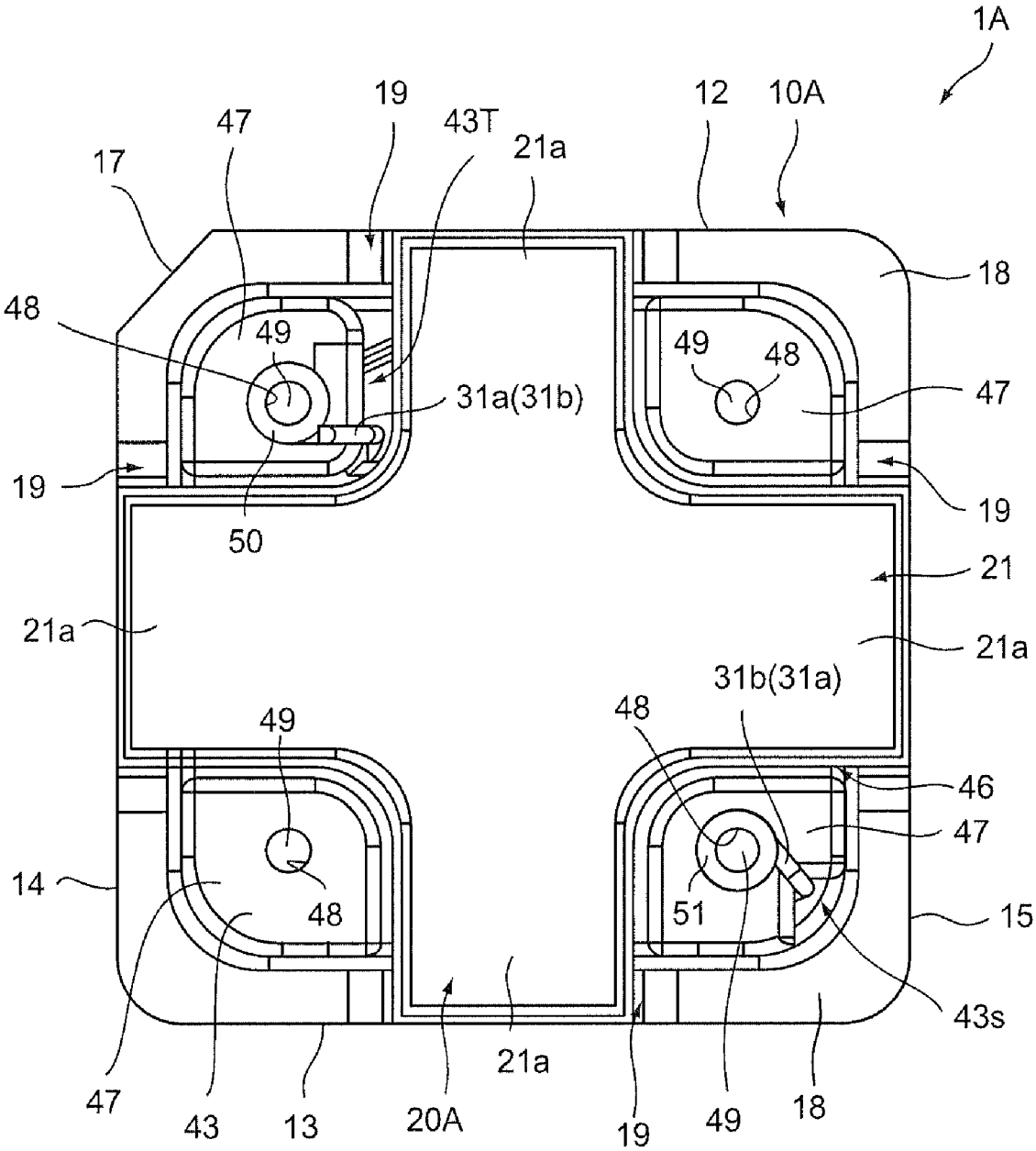
Fig.9
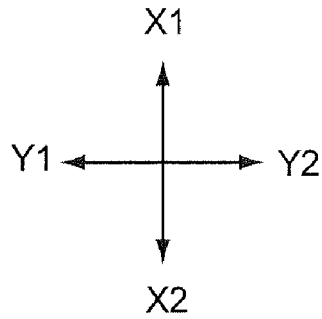

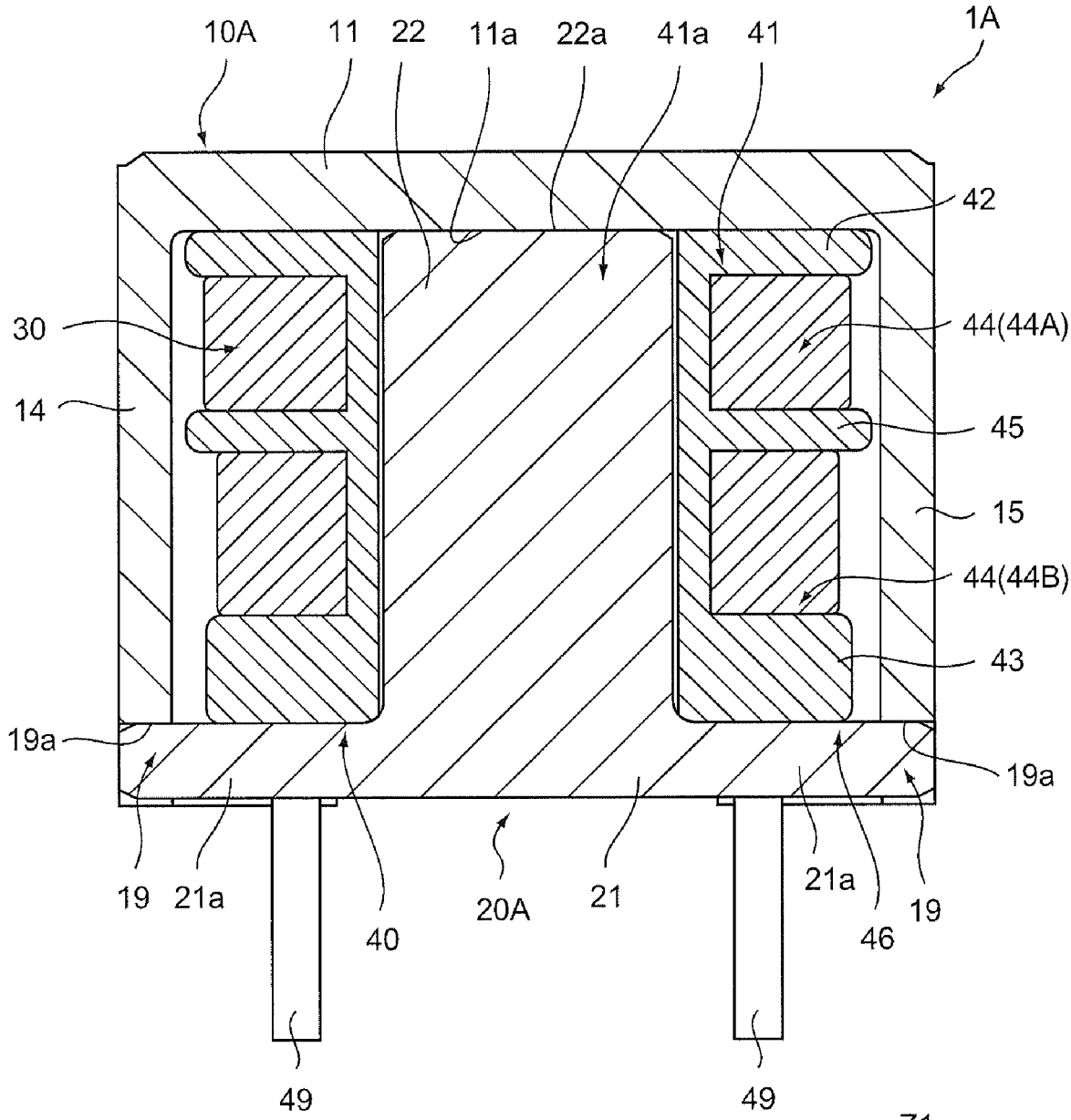
Fig.10
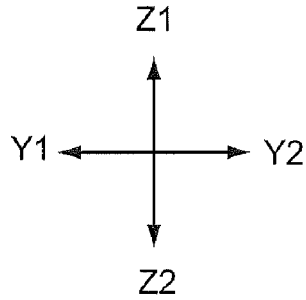

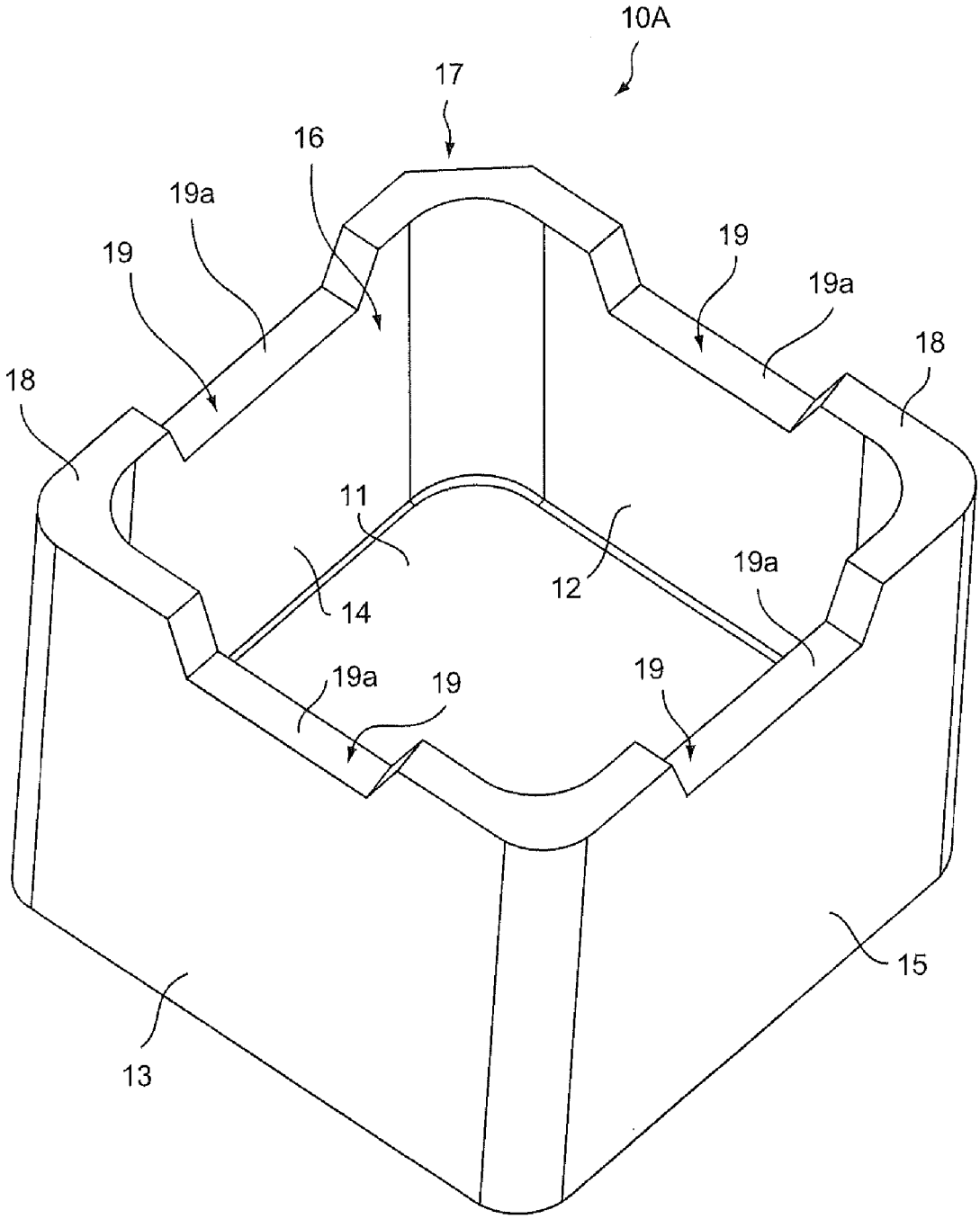
Fig.11
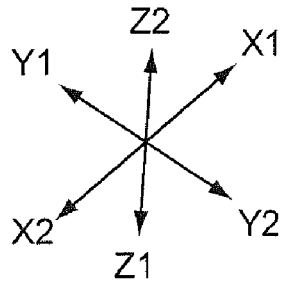

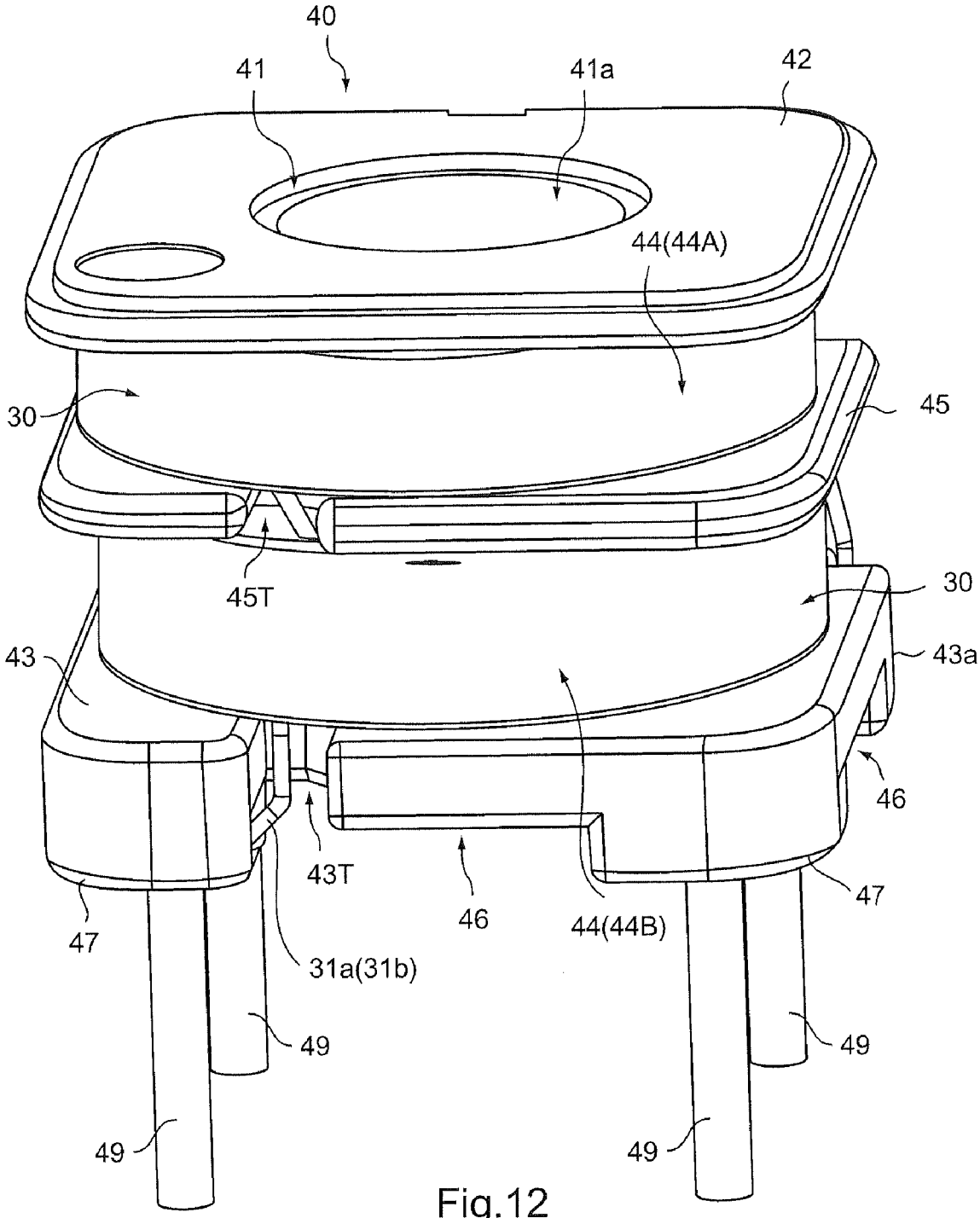
Fig.12
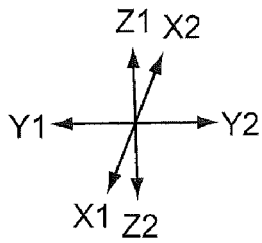

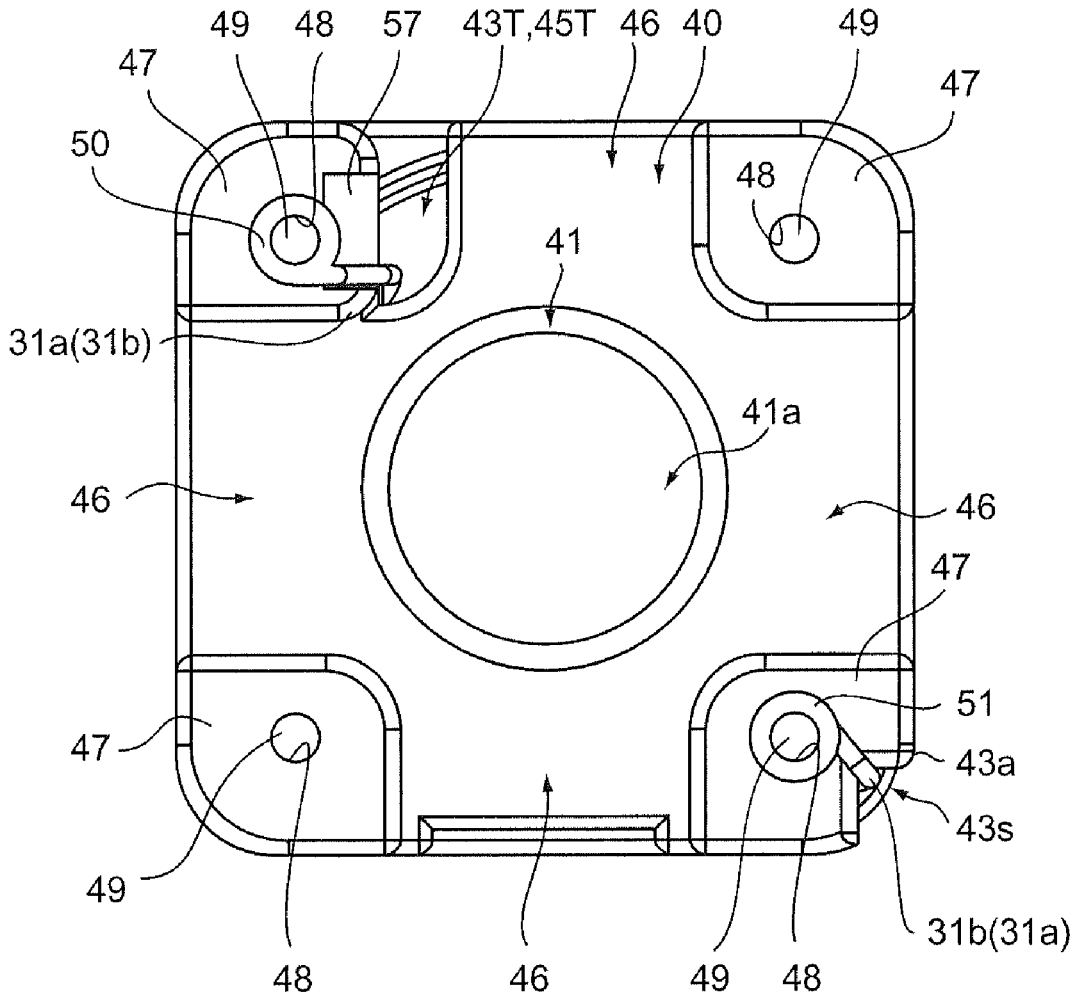
Fig.14
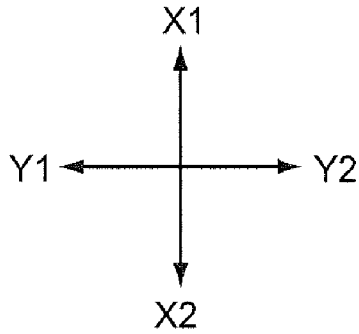

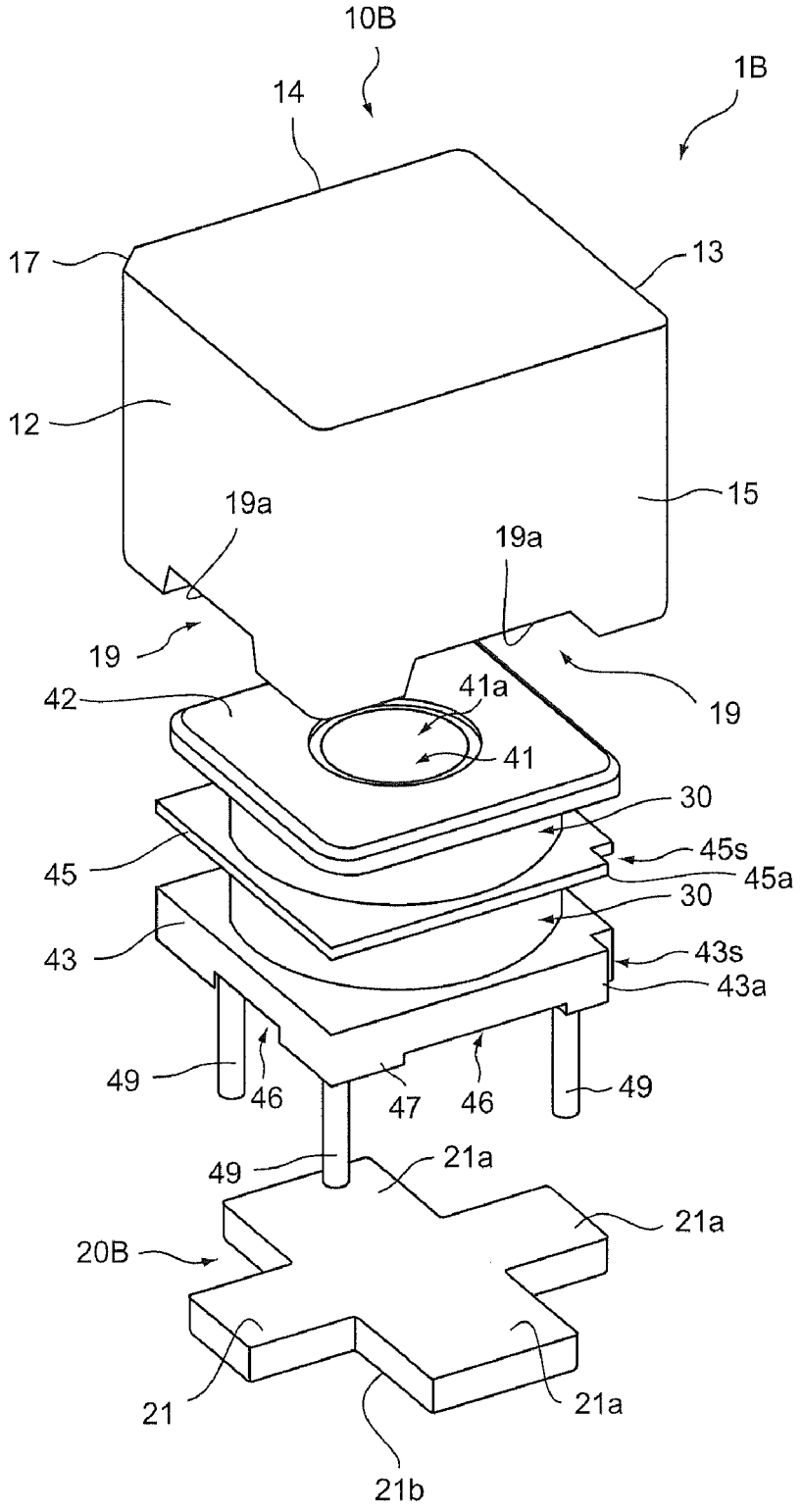
Fig.16
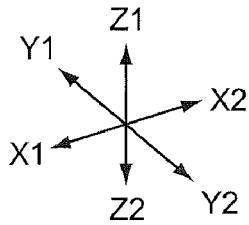

MAGNETIC ELEMENT

BACKGROUND OF THE INVENTION

1. Field of the Invention

The present invention relates to a magnetic element.

2. Description of the Related Art

Among magnetic elements, there exist ones in which two or more cores are combined. As such an element, there exists one described in Patent Document 1 for example. Patent Document 1 discloses a magnetic element in which a ring core with a lid is mounted on a flat portion of a flange of a T-shaped core.

[Patent Document 1] Japanese Patent Application Laid-open No. H10-12457 (Detailed Description of the Invention)

In the magnetic element disclosed in Patent Document 1, since the ring core with a lid is mounted on the T-shaped core, the intervention of the T-shaped core and a terminal for surface mounting, or the like makes a gap between the T-shaped core and the ring core with a lid, and there is a concern that magnetic flux leaks in a lateral direction from the gap. Further, a cutout is provided in the ring core with a lid corresponding to a pin terminal part, and there is also a concern that magnetic flux leak via this cutout. Accordingly, the inductance value of the magnetic element decreases, and there is a concern of causing electromagnetic interference in other electronic parts mounted on the same mounting substrate.

The present invention is made in view of such a problem, and an object thereof is to provide a magnetic element capable of reducing leakage of magnetic flux and ensuring the effective cross-sectional area of a magnetic path.

SUMMARY OF THE INVENTION

To solve the above-described problems, in one aspect of the present invention, a magnetic element has a winding having conductivity, and a core member disposed in a state that the winding is wound, in which the core member includes a first core member having a bottom wall and a plurality of peripheral walls provided to stand on peripheral side portions of the bottom wall, and a second core member having a plate form which is cross-shaped or substantially cross-shaped, in which cutout portions for allowing fitting of end portions of the cross shape of the second core member are formed in the peripheral walls of the first core member.

Further, preferably, on a center portion of the bottom wall forming the first core member or on a center portion of the cross shape of the second core member, a third core member having a columnar form is provided integrally.

Further, preferably, end faces of the peripheral walls forming the first core member and a lower side face formed on a side opposite to a side facing the first core member on the second core member are formed to be flush or substantially flush with each other.

Further, preferably, the magnetic element has a bobbin on which the winding is wound, in which the bobbin includes an upper flange part provided to face the bottom wall of the first core member and a lower flange part provided to face the second core member, in which in a face of the lower flange part facing the second core member, a trench portion for allowing fitting of the second core member is formed.

Further, preferably, the lower flange part has corner portions, and a first wiring trench for drawing the winding to the outside is provided in one of the corner portions on the lower flange part.

Further, a partition plate is formed between the upper flange part and the lower flange part, the partition plate has corner portions, and a second wiring trench is provided in one of the corner portions on the partition plate.

Further, the partition plate and the lower flange part have substantially square shape and the same external shape.

Further, a third wiring trench is provided at a position in a straight edge side deviated from the corner portion on the lower flange part, which is slightly deviated from a diagonal line of the lower flange part with respect to the first wiring trench.

Further, a fourth wiring trench is provided at a position in a straight edge side deviated from the corner portion on the partition plate, which is slightly deviated from a diagonal line of the partition plate with respect to the second wiring trench.

Further, terminals having a pin shape are inserted in downward projecting portions formed on the lower flange part.

Further, the winding has a first end and a second end, the first end of the winding is attached to one of the terminals, and drawn to the lower winding frame part formed between the lower flange part and the partition plate throughout the third wiring trench. The winding is wound on the lower winding frame part, drawn throughout the fourth wiring trench, and wound on the upper winding frame part formed between the upper flange part and the partition plate. The second end of the winding is drawn throughout the second wiring trench and the first wiring trench, and attached to one of the terminals except the one attached by the first end of the winding.

Further, there is a space and distance between the wind mound on the wind frame part, and the second end of the winding.

According to the present invention, it is possible to reduce leakage of magnetic flux in the magnetic element.

BRIEF DESCRIPTION OF THE DRAWINGS

FIG. 4 is a front view of the magnetic element according to the first embodiment of the present invention;

FIG. 8 is a plan view of the magnetic element according to the first embodiment of the present invention;

FIG. 9 is a bottom view of the magnetic element according to the first embodiment of the present invention;

FIG. 10 is a cross-sectional side view of the magnetic element according to the first embodiment of the present invention;

FIG. 11 is a perspective view of a pot core in FIG. 1 seen from a rear and right obliquely lower side;

FIG. 12 is a perspective view of a bobbin on which a winding is wound, seen from a front and right obliquely upper side;

FIG. 14 is a bottom view of the bobbin on which the winding is wound;

FIG. 16 is an exploded perspective view of a magnetic element according to a second embodiment of the present invention;

DETAILED DESCRIPTION OF THE PREFERRED EMBODIMENTS

First Embodiment

Hereinafter, a magnetic element 1A according to a first embodiment of the present invention will be described with reference to the drawings. Further, in the following description (in common to respective embodiments), the direction of arrow $X_1$ illustrated in FIG. 1 to FIG. 14 and FIG. 15 to FIG. 17 is specified as "front", the direction of arrow $X_2$ as "rear (back)", the direction of arrow $Y_1$ as "left" and the direction of arrow $Y_2$ as "right" which are orthogonal in a horizontal direction to both the direction $X_1$ and the direction $X_2$, and the direction of arrow $Z_1$ as "top" and the direction of arrow $Z_2$ as "bottom" which are orthogonal to the XY plane.

Figure 3:
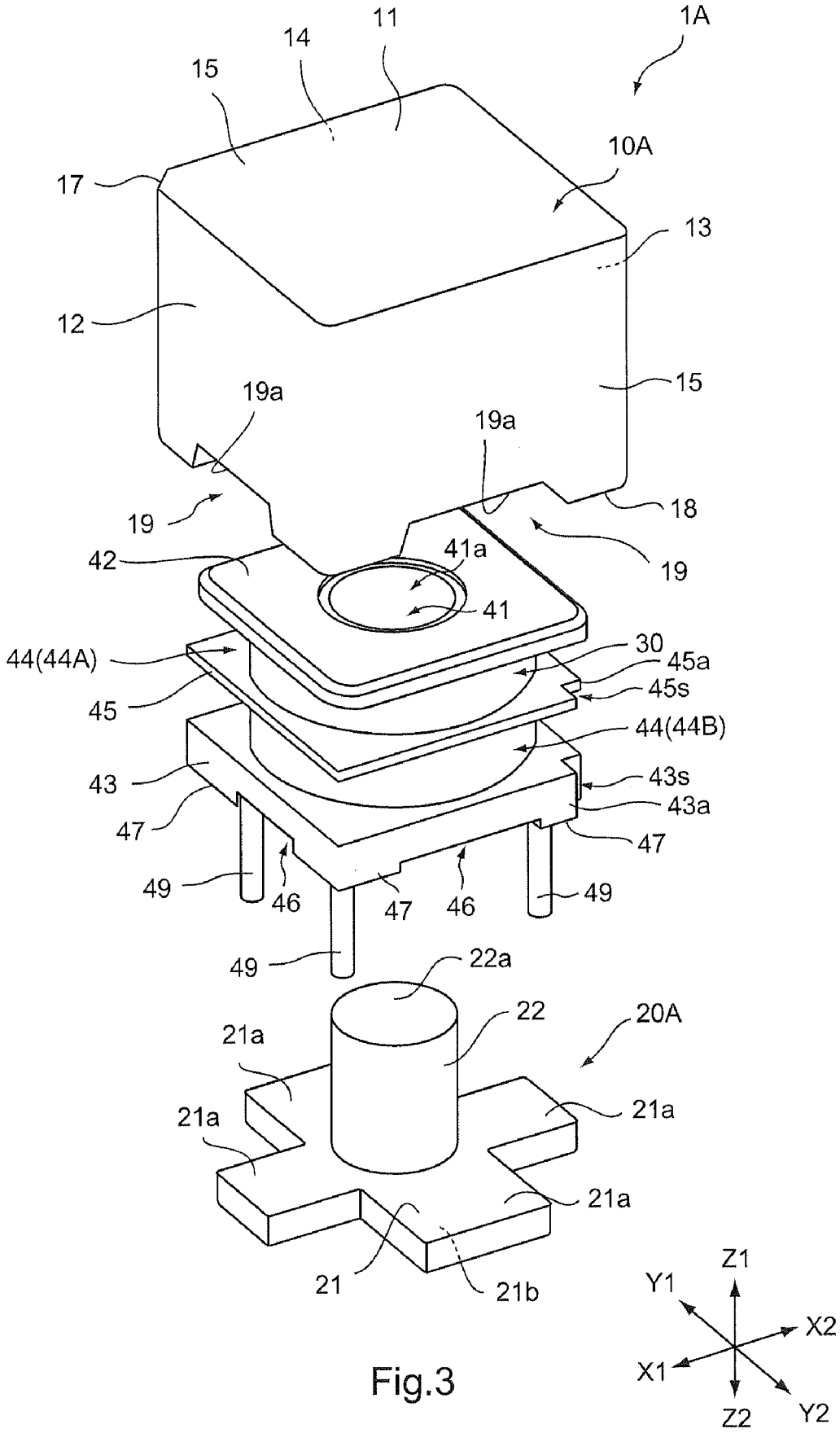
FIG. 3 is an exploded perspective view of the magnetic element according to the first embodiment of the present invention.
Figure 5:
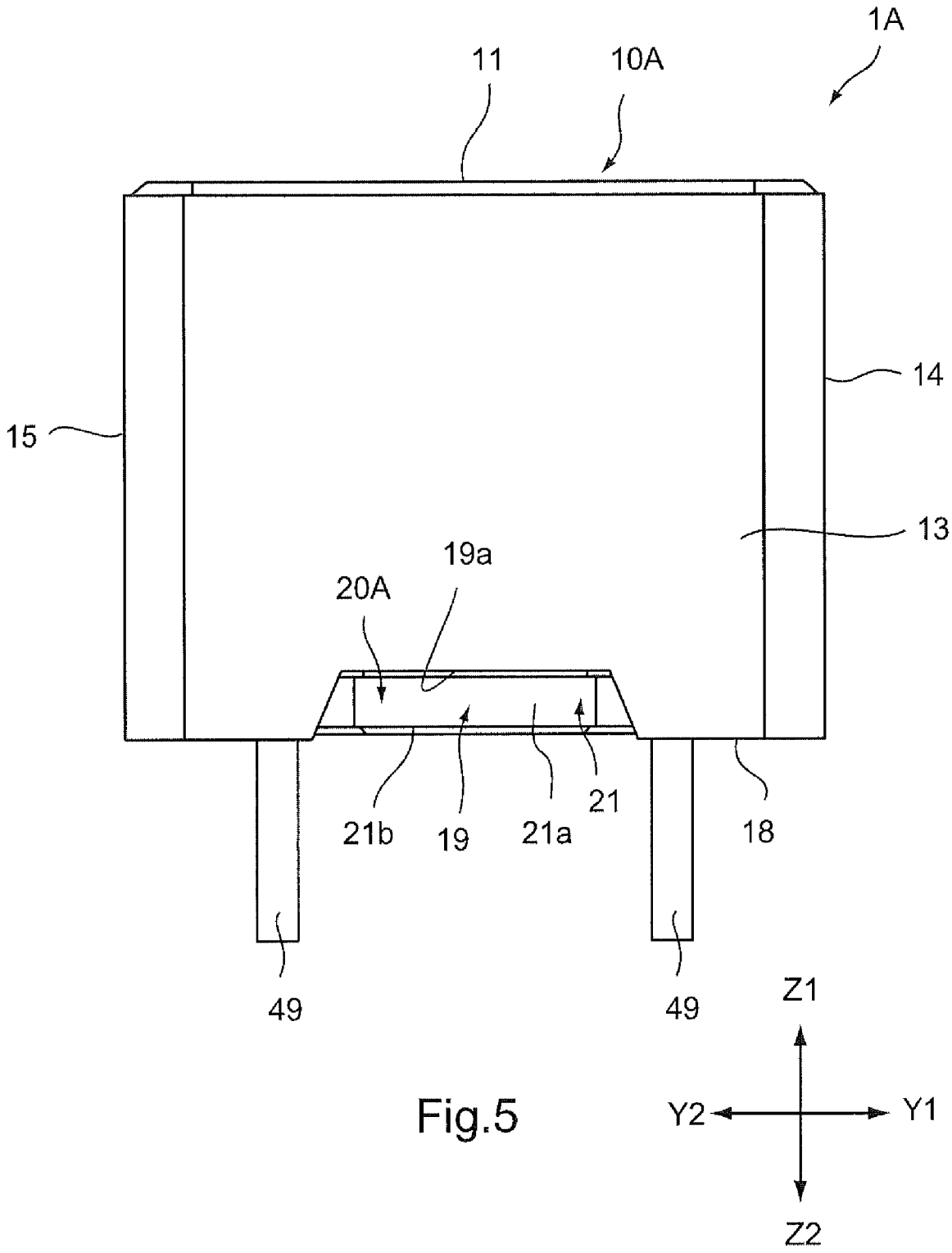
FIG. 5 is a rear view of the magnetic element according to the first embodiment of the present invention.
Figure 6:
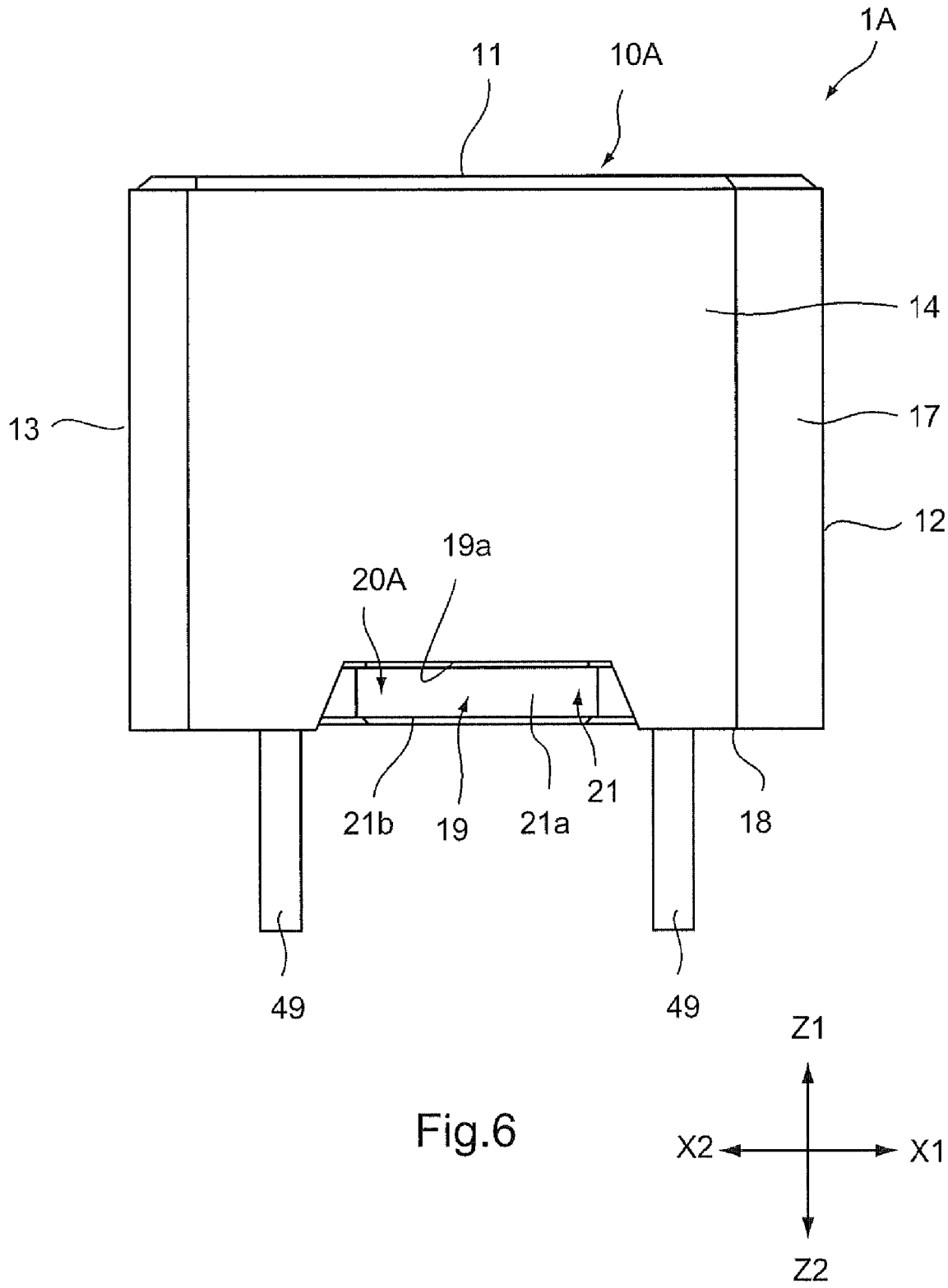
FIG. 6 is a left side view of the magnetic element according to the first embodiment of the present invention.
Figure 7:
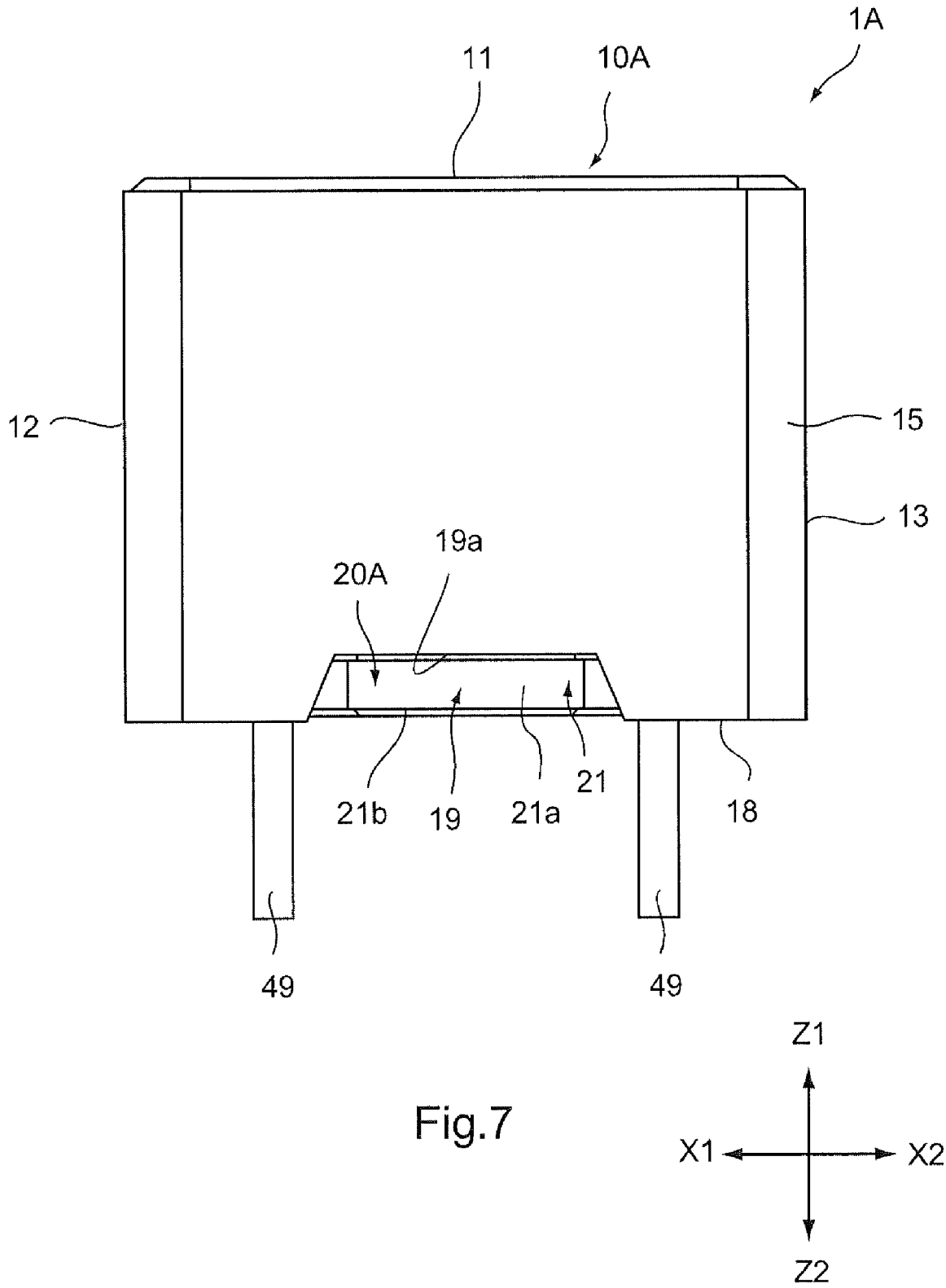
FIG. 7 is a right side view of the magnetic element according to the first embodiment of the present invention.

The magnetic element 1A is a surface-mounted type inductor for example and has, as illustrated in FIG. 3, a pot core 10A, a cross-shaped core 20A, a winding 30, and a bobbin 40 on which the winding 30 is wound.

Figure 1:
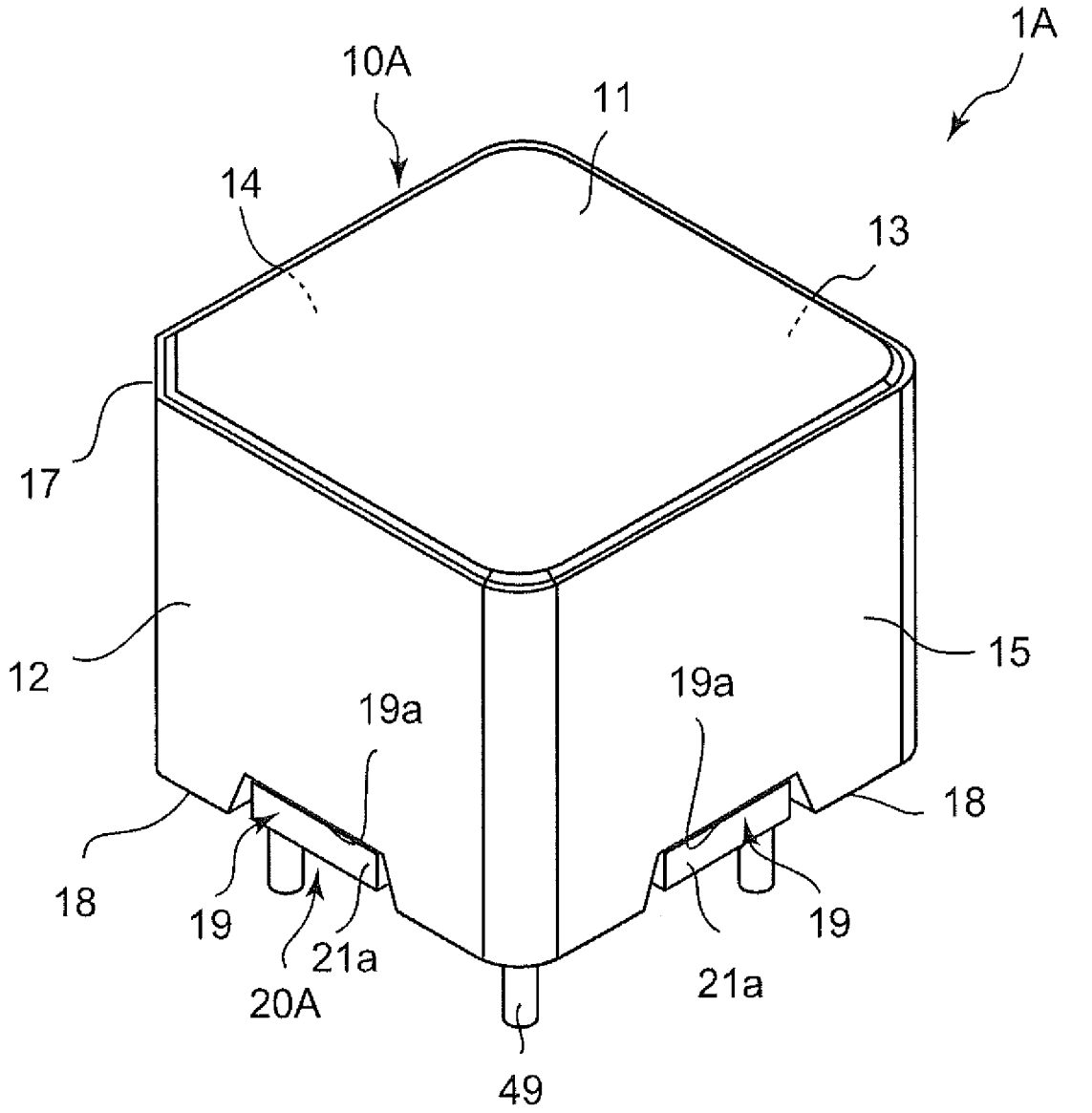
FIG. 1 is a perspective view of a magnetic element according to a first embodiment of the present invention seen from a front and right obliquely upper side.
Figure 1:
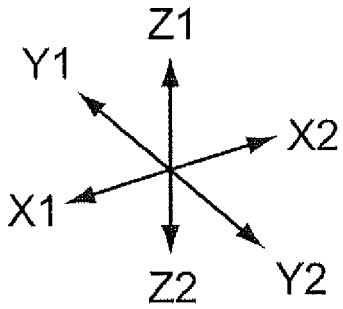

As illustrated in FIG. 1, FIG. 3 and FIG. 11, the pot core 10A has a bottom wall 11 having a square plate shape as well as a front peripheral wall 12, a rear peripheral wall 13, a left peripheral wall 14, and a right peripheral wall 15 which are provided to stand on a front, rear, left and right side of the bottom wall 11, respectively. That is, the pot core 10A has a box shape including an open space portion 16 opening downward. In addition, an outer peripheral side of the corner portion between the front peripheral wall 12 and the left peripheral wall 14 among corner portions of the pot core 10A (hereinafter, this corner portion will be referred to as a corner portion 17) is slanted to form an angle of approximately 45 degrees with respect to the front peripheral wall 12 and the left peripheral wall 14 when seen from a bottom face side, but the other corner portions have a curved surface.

Further, in each of lower end faces of the peripheral walls 12 to 15 (hereinafter, the lower end faces of the respective peripheral walls 12 to 15 will be referred to as lower end faces 18 in a unified manner), a cutout portion is formed which is cut out upward in a substantially trapezoidal shape (hereinafter, the cutout portions of the respective peripheral walls 12 to 15 will be referred to as cutout portions 19 in a unified manner). The cutout portion 19 is formed in a substantially center portion in a longitudinal direction of each of the peripheral walls 12 to 15. Further, a bottom face of the cutout portion 19 is formed in a flat shape (hereinafter, this bottom face will be referred to as a flat portion 19*a*). In this embodiment, the peripheral walls 12 to 15 are formed to have a thickness dimension smaller than 1.5 mm.

The pot core 10A is made of, for example, a magnetic material such as Ni—Zn based ferrite. However, as the material for the pot core 10A, for example, a magnetic material such as permalloy, sendust, iron or carbonyl, may be used.

Figure 2:
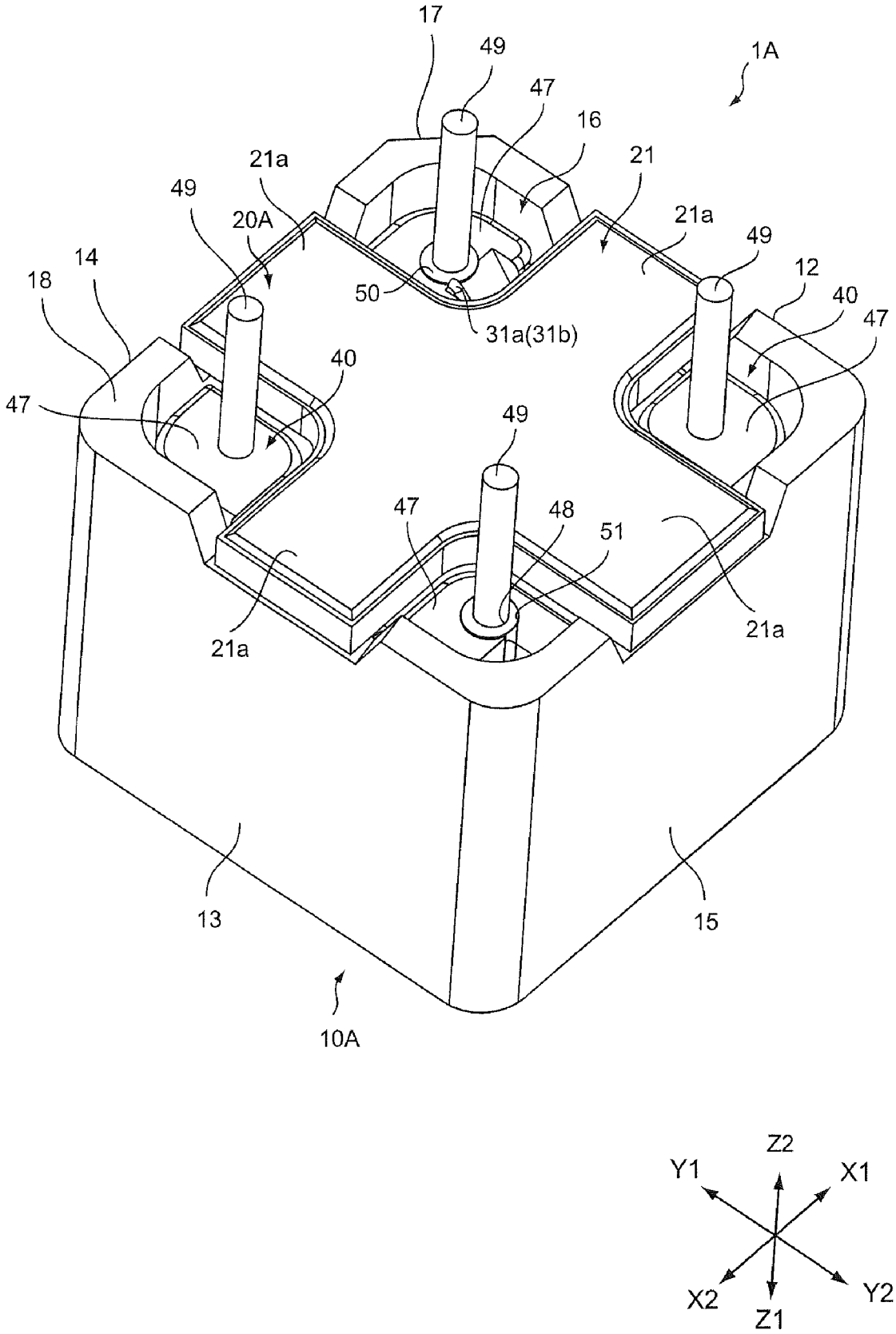
FIG. 2 is a perspective view of the magnetic element according to the first embodiment of the present invention seen from a rear and right obliquely lower side.

As illustrated in FIG. 3, the cross-shaped core 20A has a plate-shaped part 21 which is a second core member and a columnar part 22 which is a third core member. As illustrated in FIG. 2 and FIG. 3, the plate-shaped part 21 is a substantially cross-shaped flat plate. Specifically, the plate-shaped part 21 has four extending portions 21*a* extending in the forward, backward, left and right directions. This plate-shaped part 21 is disposed on a lower side of the pot core 10A in the form that the extending portions 21*a* fit in the cutout portions 19. Further, the extending portions 21*a* extending in the left and right directions are formed wider than the extending portions 21*a* extending in the forward and backward directions, so as to correspond to the cutout portions 19. Further, root portions of the extending portions 21*a* have a side face which is smoothly curved. In addition, the root portions may be formed to have a flat face. FIG. 3 shows an example that the root portions of the extending portions 21*a* have a flat face.

As illustrated in FIG. 3 and FIG. 10, the columnar part 22 has a substantially columnar shape. This columnar part 22 is formed to project upward from the center of the plate-shaped part 21. Specifically, the plate-shaped part 21 and the columnar part 22 are formed integrally. As described above, the cross-shaped core 20A is disposed on the lower side of the pot core 10A in the form that the extending portions 21*a* fit in the cutout portions 19. In this state, as illustrated in FIG. 10, the respective extending portions 21*a* abut on the flat portions 19*a* of the respective cutout portions 19, and an upper end face 22*a* of the columnar part 22 abuts on a lower side face 11*a* of the bottom wall 11. Accordingly, the cross-shaped core 20A does not rattle along a circumferential direction on the XY plane and is positioned on the pot core 10A in a state that there is no gap in a vertical direction. Further, in this state, the lower end faces of the peripheral walls 12 to 15 and a lower side face 21*b* of the plate-shaped part 21 are substantially flush with each other. In this embodiment, the thickness dimension of the plate-shaped part 21 is formed to have a dimension smaller than 1.5 mm.

The cross-shaped core 20A is made of, for example, a magnetic material such as Ni—Zn based ferrite. However, as the material for the cross-shaped core 20A, for example, a magnetic material such as permalloy, sendust, iron or carbonyl, or the like may be used.

The winding 30 is wound on the bobbin 40. The winding 30 is a wire member having conductivity covered with an insulating film of enamel or the like. As a material for this winding 30, metal that excels in conductivity such as copper is preferred, but metal such as stainless, iron or aluminum may be employed. Further, a first end 31*a* and a second end 31*b* of the winding 30 are connected respectively to terminals 49 which will be described later.

Figure 13:
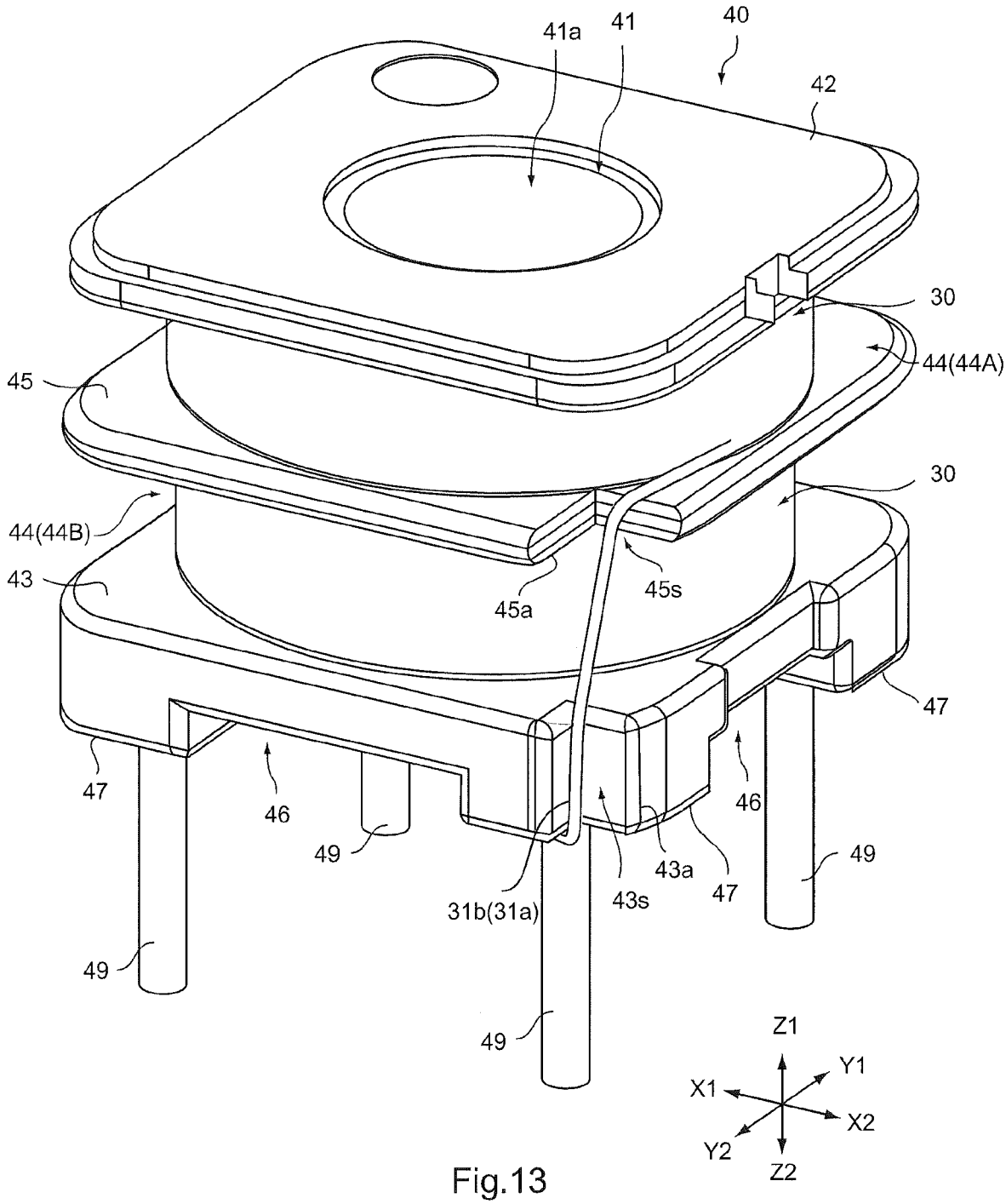
FIG. 13 is a perspective view of the bobbin on which the winding is wound, seen from a rear and right obliquely upper side.

FIG. 12 is a perspective view of the bobbin 40 on which the winding 30 is wound, seen from a front and right obliquely upper side. FIG. 13 is a perspective view of the bobbin 40 on which the winding 30 is wound, seen from a rear and right obliquely upper side. FIG. 14 is a bottom view of the bobbin 40 on which the winding 30 is wound.

As illustrated in FIG. 12 to FIG. 14, the bobbin 40 has a cylindrical part 41 whose cross section taken along the XY plane is cylindrical, an upper flange part 42 provided on an upper end of the cylindrical part 41, a lower flange part 43 provided on a lower end of the cylindrical part 41, and a partition plate 45 dividing a winding frame part 44 formed between the upper flange part 42 and the lower flange part 43 in the vertical direction. The bobbin 40 is formed of resin.

The cylindrical part 41 is a cylindrical member having a hollow air-core portion 41*a* on its center (see FIG. 10 and so on). On both upper and lower ends of the cylindrical part 41, the upper flange part 42 and the lower flange part 43 projecting outward in a radial direction from the entire face of an outer peripheral surface 36 of the cylindrical part 41 are provided. The external shapes of the upper flange part 42 and the lower flange part 43 are substantially square shapes which are the same shapes when seen in the vertical direction. On the other hand, the lower flange part 43 has a larger thickness dimension than the upper flange part 42. Outer peripheral sides of four corner portions of the upper flange part 42 are formed to have a smoothly curved shape. Further, three corner portions out of four corner portions of the lower flange part 43 are formed similarly to have a smoothly curved shape, but in one corner portion, a first wiring trench 43S which will be described later is provided (hereinafter, the corner portion in which the first wiring trench 43S is formed will be referred to as a corner portion 43*a*).

Further, from the outer peripheral surface of a center portion in the vertical direction of the cylindrical part 41, the partition plate 45 having substantially the same shape as the upper flange part 42 and the lower flange part 43 projects toward the outer peripheral side. By this partition plate 45, the winding frame part 44 formed on an outside portion of the cylindrical part 41 is divided into two upper and lower areas. Specifically, the partition plate 45 forms an upper winding frame part 44A on an upper side and a lower winding frame part 44B on a lower side. Further, the external shape of the partition plate 45 is a substantially square shape which is the same as the external shapes of the upper flange part 42 and the lower flange part 43 when seen in the vertical direction. Moreover, three corner portions out of four corner portions of the partition plate 45 are formed to have a smoothly curved shape, but in one corner portion, a second wiring trench 45S which will be described later is provided (hereinafter, the corner portion in which the second wiring trench 45S is formed will be referred to as a corner portion 45*a*).

Further, as illustrated in FIG. 14, on a lower side of the lower flange part 43, recessed fitting portions 46 are formed to be recessed upward as a substantially cross-shaped trench portion allowing fitting of a portion of an upper end side of the plate-shaped part 21 forming the cross-shaped core 20A. The recessed fitting portions 46 are formed in a shape corresponding to the plate-shaped part 21. Specifically, the recessed fitting portions 46 are portions which are recessed upward in a lower face of the lower flange part 43 excluding four corners. Note that in the following description, four corner portions of a lower face side of the lower flange part 43 excluding the recessed fitting portions 46 will be referred to as downward projecting portions 47. The above-described recessed fitting portions 46 are provided in a recessed shape corresponding to the plate-shaped part 21 of the cross-shaped core 20A.

Further, as illustrated in FIG. 13 and FIG. 14, in the corner portion 43*a* of the lower flange part 43, the first wiring trench 43S is formed, which is cut out from the outside toward the center in a radial direction of the bobbin 40. Further, in the corner portion 45*a* of the partition plate 45, the second wiring trench 45S is formed, which is cut out from the outside toward the center in the radial direction of the bobbin 40 (see FIG. 13). The first wiring trench 43S and the second wiring trench 45S are formed to communicate along the Z-axis direction.

Moreover, as illustrated in FIG. 12 and FIG. 14, in the lower flange part 43, a third wiring trench 43T is provided at a position slightly deviated from a diagonal line of the lower flange part 43 with respect to the first wiring trench 43S (a straight edge side deviated from a corner portion). Similarly, in the partition plate 45, a fourth wiring trench 45T is provided at a position slightly deviated from a diagonal line of the partition plate 45 with respect to the second wiring trench 45S (a straight edge side deviated from a corner portion) (see FIG. 12). The third wiring trench 43T and the fourth wiring trench 45T are formed to communicate along a Z-axis direction.

In the four downward projecting portions 47 formed on the lower flange part 43, four terminal holes 48 in total are provided upward from their lower side faces. Then, one ends of terminals 49 having a pin shape are inserted in the respective terminal holes 48. In a state that the terminals 49 are inserted in the terminal holes 48, four terminals 49 in total project downward.

On the bobbin 40, the winding 30 is wound on the lower winding frame part 44B, and thereafter wound on the upper winding frame part 44A. Specifically, first, a first end 31*a* of the winding 30 is attached to the terminal 49 inserted in the front left downward projecting portion 47 using a solder 50 (see FIG. 14). The winding 30 attached to the terminal 49 is drawn out to the third wiring trench 43T via a taper portion 57 formed in a taper shape. Thereafter, the winding 30 is passed through the third wiring trench 43T and wound on the lower winding frame part 44B (see FIG. 12). Further, the winding 30 wound on the lower winding frame part 44B is drawn out to the fourth wiring trench 45T, and is thereafter passed through the fourth wiring trench 45T and wound on the upper winding frame part 44A (see FIG. 12). A second end 31*b* of the winding 30 wound on the upper winding frame part 44A and the lower winding frame part 44B is drawn out to the second wiring trench 45S formed in the partition plate 45, passed through the second wiring trench 45S and the first wiring trench 43S formed in the lower flange part 43, and led to the lower side of the lower flange part 43 (see FIG. 13). The second end 31*b* of the winding 30 led to the lower side of the lower flange part 43 is attached to the terminal 49 provided on the rear right downward projecting portion 47 using a solder 51. As described above, the winding 30 is wound on the bobbin 40. That is, the terminal 49 provided on the front left downward projecting portion 47 is a winding start part, and the terminal 49 provided on the rear right downward projecting portion 47 is a winding end part.

The winding 30 has a first end 31*a* and a second end 31*b*, the first end 31*a* of the winding 30 is attached to one of the terminals 49, and drawn to the lower winding frame part 44B formed between the lower flange part 43 and the partition plate 45 throughout the third wiring trench 43T. The winding 30 is wound on the lower winding frame part 44B, drawn throughout the fourth wiring trench 45T, and wound on the upper winding frame part 44A formed between the upper flange part 42 and the partition plate 45. The second end 31*b* of the winding 30 is drawn throughout the second wiring trench 45S and the first wiring trench 43S, and attached to one of the terminals 49 except the one attached by the first end 31*a* of the winding.

The magnetic element 1A is assembled by joining the bobbin 40 on which the winding 30 is wound and the cross-shaped core 20A, and disposing the bobbin 40 with the winding 30 and the cross-shaped core 20A, which are joined, in the open space portion 16 of the pot core 10A. Specifically, first, in the air-core portion 41*a* of the bobbin 40 on which the winding 30 is wound, the columnar part 22 of the cross-shaped core 20A is inserted. That is, the columnar part 22 is inserted in the air-core portion 41*a* from a lower side of the bobbin 40 with the winding 30. Thus, in a state that the columnar part 22 is inserted in the air-core portion 41*a*, the upper side portion of the plate-shaped part 21 fits in the recessed fitting portions 46. Accordingly, the cross-shaped core 20A is positioned on the bobbin 40. Next, the bobbin 40 integrated with the cross-shaped core 20A is disposed inside the open space portion 16 of the pot core 10A. In this state, end portions of the respective extending portions 21*a* fit in the respective recessed fitting portions 46. Thus, by the end portions of the respective extending portions 21*a* fitting in the respective recessed fitting portions 46, the cross-shaped core 20A and the bobbin 40 are positioned on the pot core 10A. At this time, the upper end face 22*a* of the columnar part 22 abuts on the lower side face 11*a* of the bottom wall 11 (see FIG. 10). However, to adjust magnetic properties, a gap may be provided between the upper end face 22*a* of the columnar part 22 and the lower side face 11*a* of the bottom wall 11. Moreover, instead of the gap, a non-magnetic adhesive may be interposed between the upper end face 22*a* and the lower side face 11*a*. Through the processes as described above, the magnetic element 1A is assembled.

In the magnetic element 1A formed as described above, the extending portions 21*a* of the plate-shaped part 21 forming the cross-shaped core 20A fit in the respective cutout portions 19 in the form of abutting on the flat portions 19*a*. Accordingly, in the magnetic element 1A, leakage of magnetic flux from side faces other than these fitting portions does not occur. Therefore, magnetic flux leakage from the side faces of the magnetic element 1A can be reduced. Accordingly, it is possible to prevent reduction in inductance value of the magnetic element 1A, and electromagnetic interference to other electronic parts mounted in the same mounting substrate can be prevented.

Further, in the magnetic element 1A, the extending portions 21*a* are fitted in the respective cutout portions 19. Accordingly, the cross-shaped core 20A does not rattle along the circumferential direction on the XY plane. Further, the cross-shaped core 20A abuts on the pot core 10A in the vertical direction. Therefore, providing the cutout portions 19 allows to securely position the cross-shaped core 20A on the pot core 10A. Further, it is also possible to ensure the effective cross-sectional area of a magnetic path.

Further, the magnetic element 1A is structured such that the plate-shaped part 21 formed in a cross shape is fitted in the respective cutout portions 19. Accordingly, contact portions of the cross-shaped core 20A and the pot core 10 can be secured at least at four positions, thereby making it possible to increase the areas where the cores are in contact with each other. As a result, it is possible to form many magnetic paths in the magnetic element 1A.

Further, in the magnetic element 1A, the lower end faces 18 of the peripheral walls 12 to 15 and the lower side face 21*b* of the plate-shaped part 21 are formed to be flush with each other. Accordingly, it is possible to mount the magnetic element 1A on a substrate in a stable state.

Further, in the magnetic element 1A, the cross-shaped core 20A is provided with the columnar part 22. Accordingly, by allowing the columnar part 22 to abut on the lower side face 11*a* of the bottom wall 11, it is possible to position the cross-shaped core 20A on the pot core 10A. Further, by providing the columnar part 22, many more magnetic paths can be formed in the magnetic element 1A.

Further, the bobbin 40 is provided with the partition plate 45 and the lower flange part 43 which have a substantially square shape. Then, in the corner portion 45*a* of the partition plate 45 and the corner portion 43*a* of the lower flange part 43, the second wiring trench 45S and the first wiring trench 43S are provided. Accordingly, it is possible to guide the second end 31*b* which is the end of winding of the winding 30 to the terminal 49 while bringing it in contact with the second wiring trench 45S and the first wiring trench 43S. By thus bringing the second end 31*b* in contact with the second wiring trench 45S and the first wiring trench 43S, it is possible to secure a certain degree of space and distance between the second end 31*b* and the winding 30 wound on the winding frame part 44 of the bobbin 40. Therefore, windings 30 can be prevented from contacting each other, and thereby it is possible to provide the magnetic element 1A corresponding to high voltage. Further, since the space and distance can be secured, it is possible to prevent the magnetic element 1A from short-circuiting. Moreover, securing the space and distance makes it unnecessary to wrap the outer peripheral side of the winding 30 with a tape as an insulating material, thereby allowing cost reduction.

Figure 15:
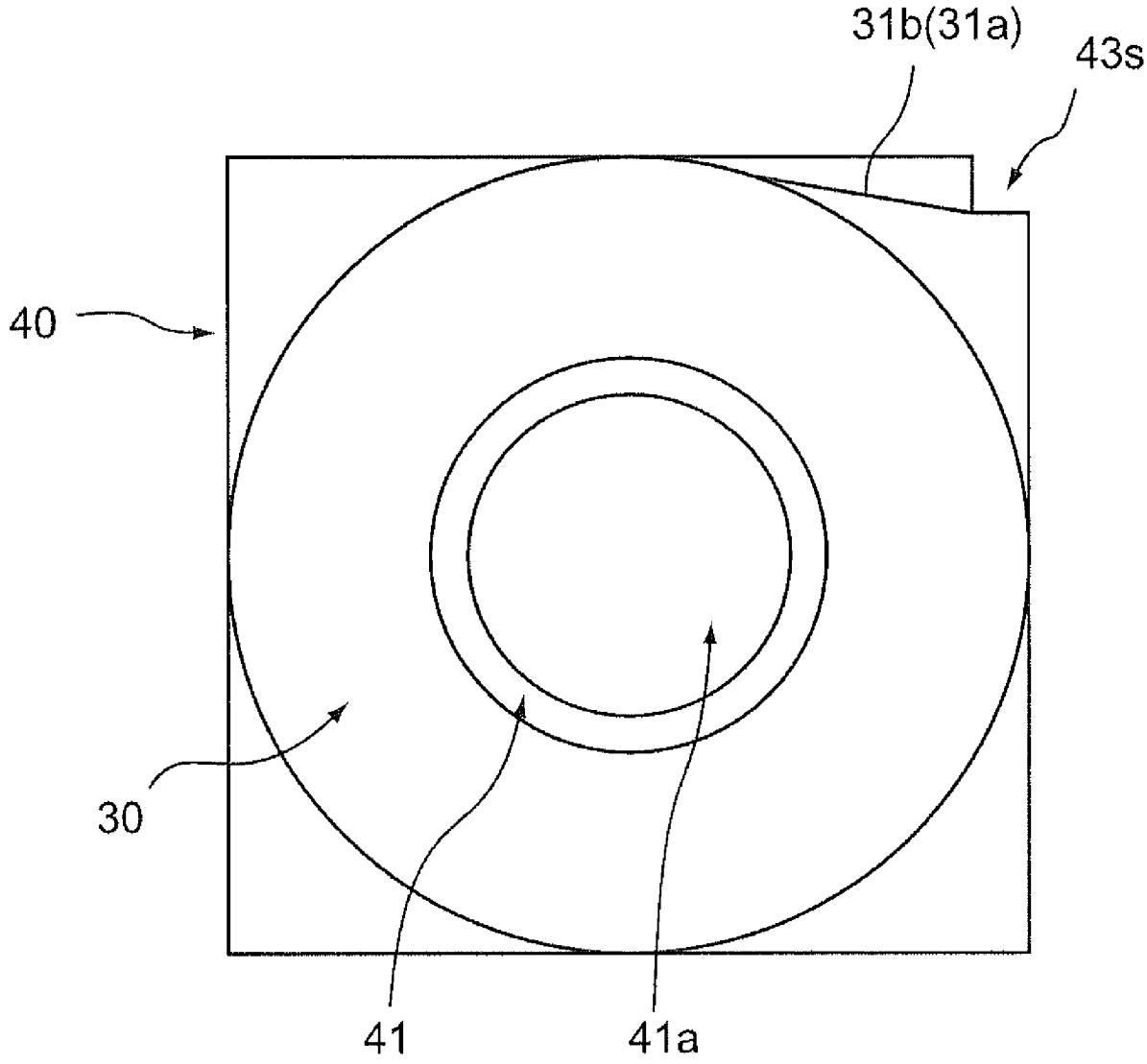
FIG. 15 is a view for describing a space and distance from the winding on the bobbin.

Further, in this embodiment, the bobbin 40 is provided with the partition plate 45 and the lower flange part 43 which have a square shape on the outer peripheral side of the cylindrical part 41 with a cylindrical cross section. As illustrated in FIG. 15, the cylindrical part 41 having a cylindrical shape is in a state that a predetermined gap exists between the winding 30 and the second wiring trench 45S or the first wiring trench 43S, even when the winding 30 is wound as outward as possible (to the outermost periphery) on the winding frame part 44. On the other hand, although not illustrated, when the winding 30 is wound on a cylindrical part of a square cylinder, almost no gap remains between the winding 30 and the second wiring trench 45S or the first wiring trench 43S, or even when the winding 30 is wound while leaving a predetermined margin, this margin becomes small. Therefore, providing the partition plate 45 and the lower flange part 43 having a square shape on the outer periphery of the cylindrical part 41 having a cylindrical shape allows to secure a larger space and distance between the outermost periphery of the winding 30 and the second end 31*b*.

Further, in this embodiment, the winding frame part 44 of the bobbin 40 is divided in two by the partition plate 45. Accordingly, the magnetic element 1A is capable of corresponding to higher voltage.

Further, in this embodiment, the fourth wiring trench 45T, the third wiring trench 43T and the second wiring trench 45S, the first wiring trench 43S are provided on the partition plate 45 and the lower flange part 43, respectively, and the winding 30 is wired using the fourth wiring trench 45T, the third wiring trench 43T and the second wiring trench 45S, the first wiring trench 43S. Accordingly, it is possible to save the space by the dimension of the winding 30.

Second Embodiment

Hereinafter, a magnetic element 1B according to a second embodiment of the present invention will be described with reference to the drawings. Note that in the magnetic element 1B according to the second embodiment, parts common to the first embodiment are denoted by the same reference numerals, and descriptions thereof are omitted or simplified. Further, in this embodiment, the structures of a pot core 10B and a cross-shaped core 20B are different from those of the first embodiment, and thus the structures of the pot core 10B and the cross-shaped core 20B will be mainly described.

As illustrated in FIG. 16, the magnetic element 1B is structured mainly from a pot core 10B, a cross-shaped core 20B, a winding 30, and a bobbin 40 on which the winding 30 is wound.

Figure 17:
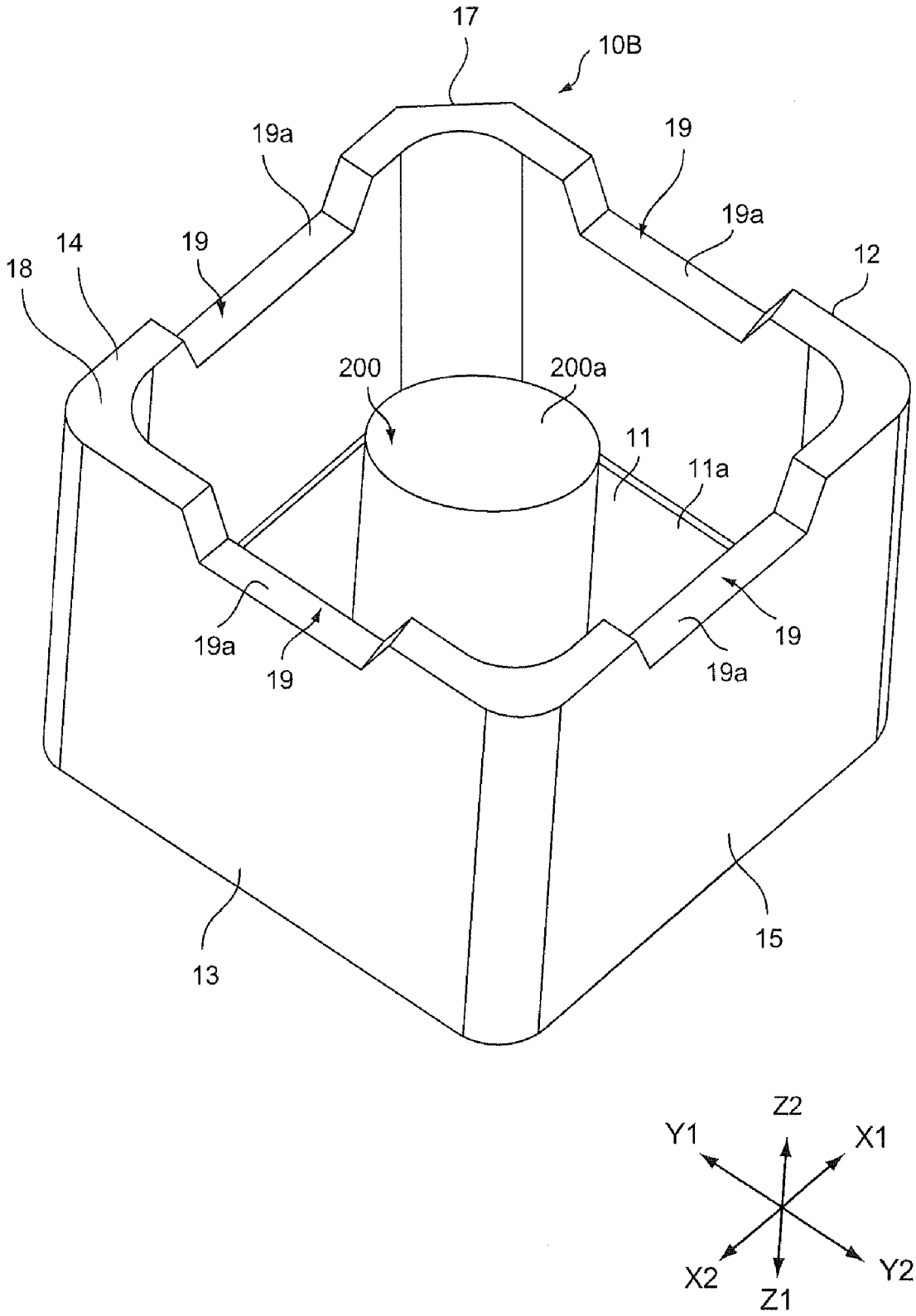
FIG. 17 is a perspective view of a pot core in FIG. 16 seen from a rear and right obliquely lower side.

As illustrated in FIG. 17, the pot core 10B is structured such that a columnar part 200 is provided on the pot core 10A in the above-described first embodiment. The columnar part 200 is formed to project downward from the center of the bottom wall 11. The columnar part 200 projects to the position such that its lower end face 200*a* is flush with the flat portions 19*a* forming the cutout portions 19. However, to adjust magnetic properties, a gap may be provided between the lower end face 200*a* and an upper face of the cross-shaped core 20B. Moreover, instead of the gap, a non-magnetic adhesive may be interposed between the lower side face 200*a* and the upper face of the cross-shaped core 20B.

As illustrated in FIG. 16, the cross-shaped core 20B is formed as a substantially cross-shaped flat plate. Specifically, the cross-shaped core 20B has extending portions 21*a* extending in the forward, backward, left and right directions. The cross-shaped core 20B is disposed on a lower side of the pot core 10B in the form that the extending portions 21*a* fit in the cutout portions 19.

In a state that the cross-shaped core 20B is disposed on the lower side of the pot core 10B, the respective extending portions 21*a* fit in the respective cutout portions 19, and the lower end face 200*a* of the columnar part 200 abuts on the upper face of the cross-shaped core 20B. Accordingly, the cross-shaped core 20B does not rattle along the circumferential direction on the XY plane and is positioned on the pot core 10B in a state that there is no gap in the vertical direction. Further, in this state, the lower end faces 18 of the peripheral walls 12 to 15 and the upper face of the cross-shaped core 20B are flush with each other.

The magnetic element 1B is assembled by inserting the columnar part 200 of the pot core 10B in the air-core portion 41*a* of the bobbin 40 having the winding 30, and further disposing the cross-shaped core 20B on a rear side of the pot core 10B. Specifically, first, while inserting the columnar part 200 in the air-core portion 41*a* of the bobbin 40, the bobbin 40 having the winding 30 is disposed in the open space portion 16 of the pot core 10B. Next, in a state that the bobbin 40 is disposed inside the pot core 10B, the cross-shaped core 20B is disposed on a lower side of them. The cross-shaped core 20B is disposed on the lower side of the pot core 10B so that end portions of the extending portions 21*a* fit in the respective cutout portions 19. Thus, by the cross-shaped core 20B fitting in the recessed fitting portions 46 of the lower flange part 43 in the bobbin 40 and also fitting in the respective cutout portions 19, the cross-shaped core 20B is positioned on the bobbin 40 and the pot core 10B. At this time, the lower end face 200*a* of the columnar part 200 abuts on the upper face of the cross-shaped core 20B. Through the processes as described above, the magnetic element 1B is assembled.

In the magnetic element 1B structured as above, the extending portions 21*a* of the cross-shaped core 20B fit in the respective cutout portions 19 in the form of abutting on the flat portions 19*a* of the pot core 10B. Accordingly, leakage of magnetic flux from side faces other than these fitting portions does not occur. Therefore, magnetic flux leakage from the side faces of the magnetic element 1B can be reduced.

Further, in the magnetic element 1B, the extending portions 21*a* are fitted in the respective cutout portions 19. Accordingly, the cross-shaped core 20B does not rattle along the circumferential direction on the XY plane, and also abuts on the pot core 10B in the vertical direction. Therefore, it is possible to securely position the cross-shaped core 20B on the pot core 10B.

Further, in the magnetic element 1B, the cross-shaped core 20B has a cross shape, and extending portions 21*a* of the cross-shaped core 20B are fitted in the respective cutout portions 19. Further, in this fitted state, the lower end face 200*a* of the columnar part 200 abuts on the upper face of the cross-shaped core 20B. Accordingly, the cross-shaped core 20B and the pot core 10B are in contact with each other at five positions, and it is possible to sufficiently secure contact portions of the cores. As a result, it is possible to form many magnetic paths in the magnetic element 1B.

Further, in the magnetic element 1B, the lower end faces 18 of the peripheral walls 12 to 15 and the lower side face 21*b* of the cross-shaped core 20B are formed to be flush with each other. Accordingly, it is possible to mount the magnetic element 1B on a substrate in a stable state.

In the foregoing, the respective embodiments of the present invention have been described, but the invention is not limited to the above-described embodiments and can be implemented in various modified modes.

In the above-described respective embodiments, the pot cores 10A, 10B are formed in a square box shape, but their shapes are not limited to a square shape and may be other polygonal box shapes of triangle, pentagon, or the like. In this case, it is desired to form the cross-shaped cores 20A, 20B having an appropriately corresponding number of extending portions 21*a*.

Further, in the above-described first embodiment, the lower end faces 18 of the peripheral walls 12 to 15 and the lower side face 21*b* of the plate-shaped part 21 are flush with each other, but they may be substantially flush with each other. Similarly, in the above-described second embodiment, the lower end faces 18 of the peripheral walls 12 to 15 and the lower side face 21*b* of the cross-shaped core 20B are flush with each other, but they may be substantially flush with each other.

Further, in the above-described embodiment, the bobbin 40 is provided with one partition plate 45, but there may be provided a plurality of partition plates 45 so as to divide the winding frame part 44 into a plurality of areas.

Further, in the above-described respective embodiments, the third wiring trench 43T and the fourth wiring trench 45T are provided one each in the lower flange part 43 and the partition plate 45, respectively. However, pluralities of the third wiring trench 43T and the fourth wiring trench 45T may be provided in the lower flange part 43 and the partition plate 45, respectively.

Further, in the above-described respective embodiments, the first wiring trench 43S and the second wiring trench 45S are provided one each in the lower flange part 43 and the partition plate 45, respectively. However, the first wiring trench 43S and the second wiring trench 45S may be provided at four positions in four corners of the lower flange part 43 and the partition plate 45, respectively, or may be provided at two positions or three positions out of the four corners.

Further, in the above-described respective embodiments, the recessed fitting portions 46 are formed on the lower side of the lower flange part 43 of the bobbin 40, but the recessed fitting portions 46 may be omitted.

Further, in the above-described respective embodiments, the angles of cutting out for the first wiring trench 43S and the second wiring trench 45S when the lower flange part 43 and the partition plate 45 are formed are not limited to about 90 degrees, and may be cut out in an acutely-angled shape.

What is claimed is:

1. A magnetic element, comprising:

a winding having conductivity; and a core member disposed in a state that the winding is wound, wherein the core member comprises:

a first core member having a bottom wall and a plurality of peripheral walls provided to stand on peripheral side portions of the bottom wall; and a second core member having a plate form which is cross-shaped or substantially cross-shaped, a bobbin on which the winding is wound, wherein cutout portions for allowing fitting of end portions of the cross shape of the second core member are formed in the peripheral walls of the first core member, wherein the bobbin comprises an upper flange part provided to face the bottom wall of the first core member and a lower flange part provided to face the second core member, and wherein the lower flange part has a corner portions, and a first wiring trench for drawing the winding to the outside is provided in one of the corner portions on the lower flange part.

2. The magnetic element according to claim 1, wherein on a center portion of the bottom wall forming the first core member or on a center portion of the cross shape of the second core member, a third core member having a columnar form is provided integrally.

3. The magnetic element according to claim 1, wherein end faces of the peripheral walls forming the first core member and a lower side face formed on a side opposite to a side facing the first core member on the second core member are formed to be flush or substantially flush with each other.

4. The magnetic element according to claim 1, wherein in a face of the lower flange part facing the second core member, a trench portion for allowing fitting of the second core member is formed.

5. The magnetic element according to claim 4, wherein a partition plate is formed between the upper flange part and the lower flange part, the partition plate has corner portions, and a second wiring trench is provided in one of the corner portions on the partition plate.

6. The magnetic element according to claim 5, wherein the partition plate and the lower flange part have substantially square shape and the same external shape.

7. The magnetic element according to claim 6, wherein a third wiring trench is provided at a position in a straight edge side deviated from the corner portion on the lower flange part, which is slightly deviated from a diagonal line of the lower flange part with respect to the first wiring trench.

8. The magnetic element according to claim 7, wherein a fourth wiring trench is provided at a position in a straight edge side deviated from the corner portion on the partition plate, which is slightly deviated from a diagonal line of the partition plate with respect to the second wiring trench.

9. The magnetic element according to claim 8, wherein terminals having a pin shape are inserted in downward projecting portions formed on the lower flange part.

10. The magnetic element according to claim 9, wherein the winding has a first end and a second end, the first end of the winding is attached to one of the terminals, and drawn to a lower winding frame part formed between the lower flange part and the partition plate throughout the third wiring trench, the winding is wound on the lower winding frame part, drawn throughout the fourth wiring trench, and wound on an upper winding frame part formed between the upper flange part and the partition plate, the second end of the winding is drawn throughout the second wiring trench and the first wiring trench, and attached to one of the terminals except the one attached by the first end of the winding.

11. The magnetic element according to claim 10, wherein there is a space and distance between the winding wound on the lower winding frame part, and the second end of the winding.

* * * * *